United States Patent [19]

Buschow

[11] 4,168,104

[45] Sep. 18, 1979

[54] ELECTRICAL RECEPTACLE

[76] Inventor: Dean W. Buschow, 1105 N. Briggs, Hastings, Nebr. 68901

[21] Appl. No.: 920,470

[22] Filed: Jun. 29, 1978

[51] Int. Cl.[2] ..... H01R 13/44

[52] U.S. Cl. ..... 339/40

[58] Field of Search ..... 339/40, 41

[56] References Cited

U.S. PATENT DOCUMENTS

| | | | |
|---|---|---|---|
| 2,155,925 | 4/1939 | Blinn | 339/40 |
| 2,336,218 | 12/1943 | Blinn | 339/40 |

FOREIGN PATENT DOCUMENTS

| | | | |
|---|---|---|---|
| 475824 | 11/1937 | United Kingdom | 339/41 |
| 498418 | 1/1939 | United Kingdom | 339/41 |
| 684702 | 12/1952 | United Kingdom | 339/40 |

*Primary Examiner*—Joseph H. McGlynn
*Attorney, Agent, or Firm*—Vincent L. Carney

[57] ABSTRACT

To provide positive blocking of the slots aligned with current-carrying contacts in a duplex safety electrical receptacle, the contacts in each of the two parts of the receptacle are blocked by two separate sliding plates. Each of the plates: (1) has slots substantially the same size as the slots in the cover of the electrical receptacle that normally receive the contacts of a plug; (2) is normally biased into a position with its slots offset from the slots in the cover of the safety duplex electrical receptacle; and (3) has sprocket holes along an edge which receive the teeth of a gear. The gear is mounted to a spring biased axle. The opening for the ground pin in each part of the duplex receptacle passes adjacent to an axle and an arm is mounted on the axle and extends into the ground pin opening so that when a plug is inserted, the ground pin moves the arm, causing the gear to rotate and move the plate so that its slots are aligned with those in the cover.

5 Claims, 4 Drawing Figures

FIG 3
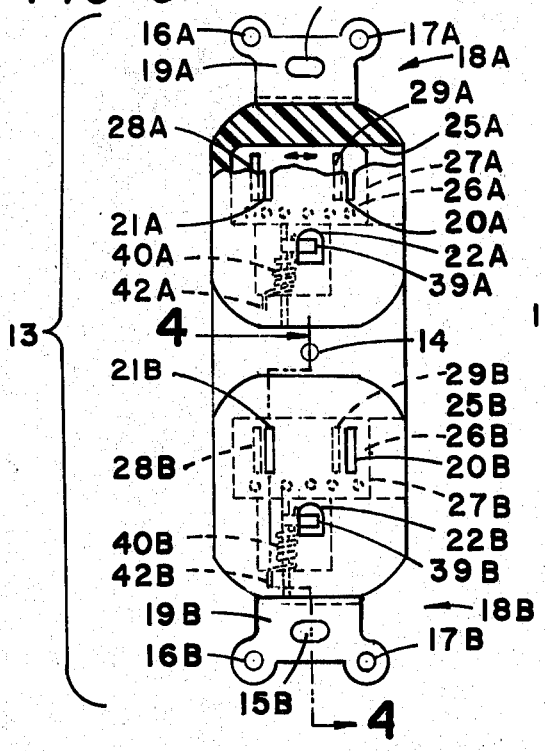
FIG 1
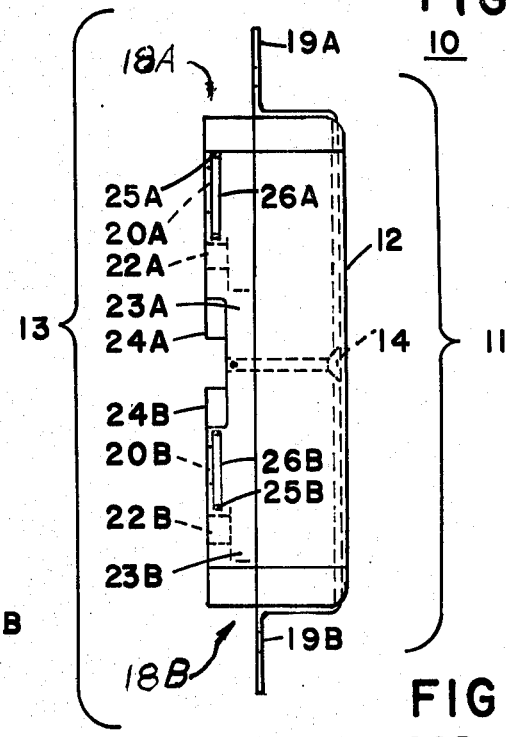
FIG 2
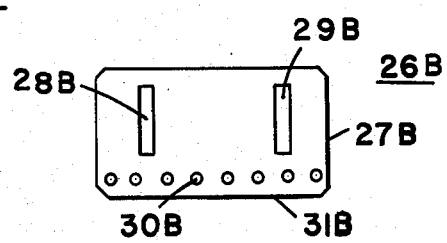
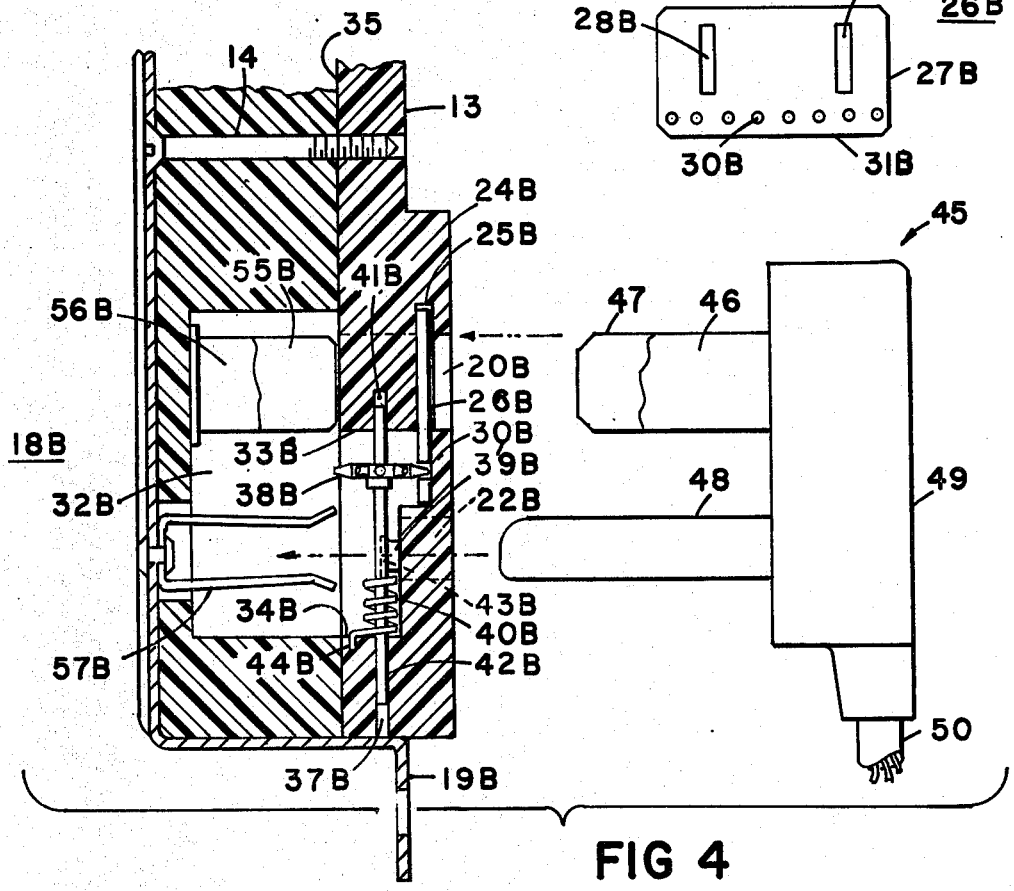
FIG 4

ELECTRICAL RECEPTACLE

This invention relates to safety electrical receptacles.

In one class of electrical receptacle, the receptacle cover includes two slots for each pair of electrical contacts to receive two conductive blades and an opening to receive a ground pin of a plug. The slots leading to the current-conducting contacts are normally blocked by shutters.

In one prior art type of this class of safety electrical receptacle, the shutters are pried open by the current-carrying prongs of the plug, which then slide past the shutters and into contact with the electrical contacts within the receptacle.

The prior art type of safety receptacle has the disadvantages of permitting the slots which receive the electrical prongs to be opened by a file or the like and thus permitting a child to receive a shock. Moreover, some of them are unduly complex and expensive.

In another prior art type of this class of safety electrical receptacle, the shutters are pivoted angularly by a camming surface that engages the ground pin.

This type of prior art safety electrical receptacle has the disadvantage of requiring either that the edge of the shutters be close to the plug blade slots or that the lateral dimension of the receptacle be large to accommodate the swing of the furthest end of the shutter from the pivot point. If the edge of the shutter is close to the plug blade slot, the shutter may be pried aside with a file or the like at that point.

In still another prior art type of this class of safety electrical receptacle, a pivot deforms a shutter to clear the normally blocked plug blade slots. This type of prior art safety electrical receptacle has the disadvantage of being unreliable, excessively subject to damage and worn out after relatively light use.

Accordingly, it is an object of the invention to provide an improved electrical safety receptacle.

It is a further object of the invention to provide a novel safety receptacle which includes a positive blocking element to preclude the inadvertent entrance of a foreign object into engagement with current-conducting contacts.

It is a still further object of the invention to provide a novel safety electrical receptacle which functions only with a three-contact electrical plug.

It is a still further object of the invention to provide a novel safety electrical receptacle which is constructed with a minimum number of simple parts.

It is a still further object of the invention to provide a novel electrical receptacle which is capable of being economically manufactured.

It is a still further object of the invention to provide an electrical safety receptacle in which the insertion of a ground pin moves a shutter laterally to align two guide slots with the plug blade slots of the receptacle.

In accordance with the above and further objects of the invention, a safety electrical receptacle includes a ground pin opening positioned in a conventional location with respect to each pair of openings for the current-carrying contacts. An axle is positioned at the side of the ground pin opening and an arm extends from the axle beneath said opening. A gear is mounted to the axle for rotation therewith and engages a plate that includes two slots of suitable size for passing the prongs of a plug.

The axle is normally biased to hold the plates with the slots offset from the slots in the cover of the safety receptacle so that they positively block entrance of a conductor therein. When a three-pronged plug is inserted, the ground pin moves the arm, which rotates the axle against its biasing force to move the plate so that its slots are aligned with the slots in the safety receptacle and the current-carrying contacts may pass and engage the electrical contacts within the receptacle.

As may be understood from the summary, the safety receptacle of this invention has several advantages such as: (1) it is simple, inexpensive, and requires only a few parts; and (2) it provides positive blocking of the electrical contacts to prevent accidentally camming them aside to contact the current-carrying electrical contacts therein.

With the above noted and other features of the invention, it will be better understood from the following detailed description considered with reference to the accompanying drawings in which:

FIG. 1 is a side view of a safety receptacle in accordance with the invention;

FIG. 2 is a plan view of a portion of the embodiment of FIG. 1;

FIG. 3 is a plan view, partly broken away of the embodiment of FIG. 1; and

FIG. 4 is a fragmentary, partly-sectioned and partly-broken away view of the embodiment of FIG. 1.

In FIG. 1, there is shown a duplex electrical safety receptacle 10 having as parts an insulated parallelopiped-shaped housing 11 consisting of two parts, a base 12 and a cover 13 joined by a fastener, which may be any type of conventional fastener such as a conventional rivet which has 6/32 inch threads located on the end that holds the cover to the base. This threaded rivet then accepts the 6/32 screw for fastening the receptacle plate to the receptacle. The base 12 contains the electrical contacts (not shown in FIG. 1) necessary to complete the receptacle.

To permit two electrical plugs to make contact with the power supply, the cover 13 includes two individual receptacle portions 18A and 18B, each having a pair of parallel spaced apart plug blade slots leading to the electrical current-conducting contacts (not shown in FIG. 1) with the right hand slots 20A and 20B being indicated in FIG. 1. Each receptacle portion 18A and 18B of the cover 13 includes a third opening 22A and 22B respectively to receive the ground prong of the plug for the purpose of connection with the ground contact (not shown in FIG. 1).

To prevent accidental electrical contact within the receptacle 10 such as by a child playing with it or the like, the individual receptacle portions 18A and 18B of the cover portion 13 each include a corresponding one of the raised sections 24A and 24B having respective ones of the slots 25A and 25B in them orthogonally through their longer sides 23A and 23B parallel to the front surface of the cover 13. Corresponding ones of the flat blocking plates 26A and 26B are movably mounted in the blocking member slots 25A and 25B which extend through the sides of the receptacle sections 18A and 18B of the cover 13. The two blocking plates 26A and 26B have at least two different positions, a normal position in which they block the plug blade slots and another actuated position which permits a plug to be inserted through them as will be explained more fully hereinafter.

To close the housing 11 of the receptacle 10, the base portion 12 includes a box like portion which holds the current-carrying contacts and ground contacts (not shown in FIG. 1) and is mounted to the cover 13 by a screw shown for illustration as a machine screw 14 although a better practice is to use an internally threaded rivet to receive a screw. The base portion 12 includes outwardly extending flange portions 19A and 19B, which are conventional and used for fastening to an outlet box or to a single gang box cover or the like.

As best shown in FIG. 2, the blocking plate 26B is a flat plate, made of an insulating material such as nylon or other suitable plastic, and having a pair of parallel spaced-apart guide slots 28B and 29B extending through its faces. The guide slots 28B and 29B are of sufficient size and spacing between each other to permit the plug blades to pass through the guide slots when the blocking plate is aligned with the plug blade slots in the cover 13 (not shown in FIG. 2) and to block them in other positions. Extending parallel to the edge 31B of the blocking member 26B and perpendicular to its narrower edge 27B are a plurality of equally spaced circular apertures 30B for engagement with the teeth of a gear.

As best shown in FIG. 3, the flanges 19A and 19B each include corresponding ones of the center mounting openings 15A and 15B and right and left ears, two of them 16A and 17A being on flange 19A and two others 16B and 17B being on flange 19B, each of the ears 16A and 16B, 17A and 17B having central apertures through them. The flanges 19A and 19B are to hold the receptacle flush to the finished wall or box while 15A and 15B are to receive screws for mounting the receptacle. The plug-blade receiving slots 20B and 21B are normally blocked by the blocking plate 26B (shown in FIG. 1) and the plug-blade receiving slots 20A and 21A are normally blocked by the blocking plate 26A (shown in FIG. 1) so that a plug conductor cannot be inserted accidentally through the slots into the receptacle to make contact with the current-carrying contacts therein.

To unblock the plug-blade receiving slots 20A, 20B, 21A and 21B of the cover 13, the receptacle portions 18A and 18B each include a corresponding one of the two spring biased axles 42A and 42B, two arms 39A and 39B and the two torsion springs 40A and 40B. The ground-prong openings 22A and 22B in the cover 13 are partly blocked by the respective arms 39A and 39B which are mounted to and extend from the rotatable axles 42A and 42B respectively.

The axles 42A and 42B are mounted adjacent to their respective openings 22A and 22B beneath the top plate of the cover 13 in a direction parallel to, but offset from, the longitudinal axis of the duplex receptacle 10. They are spring biased by the torsion springs 40A and 40B respectively to hold the blocking arms 39A and 39B normally aligned with the openings 22A and 22B respectively but to permit rotation under pressure away from the opening and downwardly into the receptacle. The axles 42A and 42B are also mounted to gears (not shown in FIG. 3) which engage the sprocket holes of the blocking members 26A and 26B and move them into a position where the guide slots 28A, 28B, 29A and 29B are aligned with the plug-blade receiving slots 20A, 20B, 21A and 21B to permit entry of the prongs of an electric plug. In practice, slots 21A, 21B, 28A and 28B are longer than slots 20A, 20B, 29A and 29B.

In FIG. 4, there is shown a portion of the duplex safety receptacle 10 and a cooperating electrical plug 45. As best shown in this figure, the receptacle 18B includes in its cover member 13 a cavity communicating with the electrical contact recess 32B of the receptacle. Two diametrically opposed parallel sides 33B and 34B of this cavity have a cylindrical bearing recess 41B and a cylindrical recess 37B extending into them respectively. The axle 42B has one end retained rotatable within the cylindrical bearing recess 41B and its other end retained within the cylindrical bearing recess 37B for rotation therein. Mounted to the axle 42B for rotation therewith is a pinion 38B within the cavity which engages with its teeth the holes 30B in the blocking member 26B. The blocking arm 39B is similarly mounted to the axle 42B by any suitable means for rotation therewith.

To bias the axle 42B in a position with the arm 39B over the ground prong opening 22B and the blocking element 25B with its slots 28B and 29B (FIGS. 2 and 3) offset from the openings 20B and 21B (FIG. 3) the helical torsion spring 40B has one of its ends at 44B mounted to the side 34B such as by being staked thereto and its other end 43B attached by any suitable means such as by welding to the axle 42B for rotation therewith. The remainder of the torsion spring circumscribes the axle and is biased in such a way to hold the arm 39B over the opening 22B.

Within the receptacle 18B are the conventional electrical contacts for receiving a conventional three-pronged plug. In the embodiment shown in FIG. 4, there are shown a set of ground contacts 57B and two current-carrying contacts 55B and 56B positioned beneath the openings 39B, 21B and 20B respectively.

The slots, electrical contacts, and safety mechanism are all adapted to operate with a conventional three-pronged plug 45 having two current-carrying blade contacts 46 and 47 and a ground prong 48 electrically connected through a plastic housing 49 to the appropriate conductors in an electrical cable 50. The ground prong 48 is of such a size as to fit through the opening 22B and to move the arm 39B to unblock the slots 20B and 21B. The slots 28B and 29B (FIGS. 2 and 3) are spaced apart the necessary distance to be aligned with the slots 20B and 21B (FIG. 3) and are of a conventional size to receive the electrical contacts 46 and 47.

The lateral movement of the blocking plates or shutters 26A and 26B is proportional to the angle that the corresponding shaft 42A and 42B is turned by the ground prong 48 and corresponding arm 39A and 39B. It is also proportional to the diameter of the corresponding gear 38A and 38B. The distance that the guide slots 28A, 28B, 29A and 29B are offset from the plug-blade slots 20A, 20B, 21A and 21B of the cover 13 in the normal or closed position is selected by the distance the blocking plates are moved by the insertion of the ground prong 48 before the plug blades 46 and 47 reach the blocking plate, which distance is proportional to the angle of shaft rotation and diameter of gear. Accordingly, the size gear, position of axle, location of gear and axle and location of slots may be calculated or obtained by experiment in a manner known in the art. It has been discovered surprisingly that sufficient offset of the guide slots is possible to preclude prying of the blocking plates by a file or the like.

Within the receptacle 18B, the blades of ground contact 57B are spaced apart to receive the pin 48 and are electrically contacted by a rivet to an appropriate ground strap. Similarly the current-carrying contacts 55B and 56B are connected to the appropriate power supply to make separate electrical contact with the prongs 46 and 47 of the plug 45.

Although blocking plates which slide laterally have been shown, it is obvious that other configurations may be used while still using the principle of a gear drive to enable adequate motion for the blocking member. For example, instead of a plate driven by a gear, cylinders having guide slots through them could be rotatably mounted below the plug-blade slots in the cover and driven by the gear to cause the slots to be at an angle to the slots in the cover until the actuator arm is moved and then be aligned by further rotation.

Before using the duplex safety electrical receptacle 10, it can be mounted in an outlet box or switch box, or junction box with the appropriate screws through the center mounting openings 15A and 15B. The apertures 16A and 16B and 17A and 17B are used for holding the receptacle flush with the finish wall. The electrical contacts 55A and 55B and 56A and 56B are mechanically connected to the screws located on the sides of the base (not shown on drawing). Connected to the screws is the branch circuit supply or other source of power and the ground contacts 57A and 57B are mechanically fastened to the ground strap.

In use, a three-pronged electrical plug such as 45 is inserted into the receptacle to make electrical contact through a cable 50 to an electrically operated device such as to an electric home appliance or the like. The plug may be inserted either in the receptacle section 18A or the receptacle section 18B since these sections are substantial duplicates of each other and operate in the same manner.

To insert the plug 45, it is aligned with one of the receptacle sections such as 18B, with the ground prong 48 aligned with the opening 22B, the right hand blade contact 47 aligned with the slot 20B in the cover 13 and the left hand contact 46 aligned with the slot 21B. The receptacle is then pushed inwardly so that the pin 48 moves into the opening 22B and pushes the arm 39B, rotating the axle 42B.

The rotation of the axle 42B rotates the gear 38B, the teeth of which engage the sprocket openings 30B to move the blocking plate 26B. The blocking plate 26B moves to the right (as seen in FIG. 3) until the guide slots 28B and 29B are aligned with the plug-blade slots 20B and 21B of the receptacle cover 13B. While in this position with the plug 45 being moved further into the receptacle, the blades 46 and 47 move downwardly and contact the electric contacts 56B and 55B respectively and the prong 48 contacts the blades of the contact 57B within the receptacle to establish an electrical connection to the conductors within the cord 50.

When the plug 45 is removed by pulling the housing 49 away from the receptacle 13B, the blades 46 and 47 are pulled free from the contact 55B and 56B. Next the ground pin 48 is pulled free and the contacts move outwardly through the slots 28B and 29B of the blocking member 26B and the slots 21B and 20B of the receptacle. As the pin 48 is moved out of the opening 22B, the torsion spring 40B rotates the axle 42B and the gear 38B, moving the blocking member 26B laterally so that the slots 28B and 29B are offset from the slots 21B and 20B.

From the above description, it can be understood that the duplex safety receptacle of this invention has several advantages, such as: (1) it is simple in construction and relatively inexpensive; (2) it is capable of being economically manufactured; (3) it functions only with a three-contact electrical plug unless an adapter is used; (4) it cannot be accidentally opened by probing with a sharp object such as a nail file or the like within the slots intended to receive current-carrying blade contacts; and (5) it provides a positive block against entry.

Although a preferred embodiment of the invention has been described in considerable detail, many modifications and variations in the embodiment may be made without deviating from the invention. Accordingly, it is to be understood that, within the scope of the appended claims, the invention may be practiced other than as specifically described.

What is claimed is:

1. An electrical safety receptacle for use with a three-contact electrical plug, comprising:

a housing;

said housing including a base member and a cover member;

said base member having two current-conducting contacts and a ground contact;

said cover member having a plurality of openings leading to said current-conducting and ground contacts;

a blocking member having at least first and second portions with respect to said openings;

said blocking member including means for at least partly blocking said openings leading to said current-carrying contacts in a first position and not blocking said opening leading to said current-carrying contacts in a second position;

means normally biasing said blocking member into said first position;

means for moving said blocking member to said second position when a third contact enters said opening leading to said ground contact;

said means for moving including a first motion transmision means mounted to said blocking member and a second motion transmission means mounted so that the motion of said second motion transmission means drives said first motion transmission means;

means for moving said second motion transmission means without substantial motion of said second motion transmission means parallel to the plane of said openings when said third contact enters said opening leading to said ground contact;

means for movably mounting said blocking member;

said means for movably mounting blocking member including internal walls in said cover member forming a slot parallel to the front surface of said cover member;

said blocking member being a plate movably positioned in said slot;

said blocking member comprising internal walls forming a pair of parallel spaced-apart openings which dimensionally match said openings leading to said current-conducting contacts in said base member and means for engaging said means for moving said blocking member from said first position to said second position when said third contact enters said opening leading to said ground contact;

said means for moving comprising an axle and a torsion spring;

said axle having a pinion gear and actuator arm attached thereo;

said torsion spring being axially engaged around said shaft and having a first end attached to said actuator arm and a second end attached to said cover; and the teeth of said pinion gear engaging said blocking member.

2. An electrical safety receptacle in accordance with claim 1 in which said actuator arm is positioned in line with said opening leading to said ground contact.

3. An electrical safety receptacle in accordance with claim 1 in which said actuator arm is positioned in line with said opening leadng to said ground contact.

4. An electrical safety receptacle for use with a three-contact electrical plug comprising:

a housing;

said housing including a base member and a cover member;

said base member having two current-conducting contacts and a ground contact;

said cover member having a plurality of openings leading to said current-conducting and ground contacts;

a blocking member having at least first and second positions with respect to said openings;

said blocking member including means for at least partly blocking said openings leading to said current-carrying contacts in a first position and not blocking said opening leading to said current-conducting contacts in a second position;

means normally biasing said blocking member into said first position;

means for moving said blocking member to said second position when the third contact enters said opening leading to said ground contact;

said means for moving including a first motion transmission means mounted to said blocking member and a second motion transmission means mounted so that the motion of said second motion transmission means drives said first motion transmission means;

means for moving said second motion transmission means without substantial motion of said second motion transmission means parallel to the plane of said openings when said third contact enters said opening leading to said ground contact;

said blocking member comprising internal walls forming a pair of parallel spaced-apart openings which dimensionally match said openings leading to said current-conducting contacts in said cover member and means for engaging said means for moving said blocking member from said first position to said second portion when said third contact enters said opening leading to said ground contact;

said means for moving comprising an axle and a torsion spring;

said axle having a pinion gear and actuator arm attached thereto;

said torsion spring being axially engaged around said shaft and having a first end attached to said actuator arm and a second end attached to said cover; and the teeth of said pinion gear engaging said blocking member.

5. An electrical safety receptacle in accordance with claim 4 in which said actuator arm is positioned in line with said opening leading to said ground contact.

* * * * *

UNITED STATES PATENT AND TRADEMARK OFFICE

CERTIFICATE OF CORRECTION

PATENT NO. : 4,168,104

DATED : September 18, 1979

INVENTOR(S) : Dean W. Buschow

It is certified that error appears in the above-identified patent and that said Letters Patent are hereby corrected as shown below:

Column 6, line 37 and 38, change the word "transmision" to "transmission".

Column 8, line 18, change the word "portion" to "position".

Signed and Sealed this

*Twenty-sixth* Day of *February 1980*

[SEAL]

*Attest:*

SIDNEY A. DIAMOND

*Attesting Officer*

*Commissioner of Patents and Trademarks*